United States Patent [19]

Willmann et al.

[11] 4,077,374

[45] Mar. 7, 1978

[54] INJECTION VALVE FOR INTERNAL COMBUSTION ENGINES

[75] Inventors: Karl Willmann, Buchenbach; Helmut Säufferer, Esslingen, both of Germany

[73] Assignee: Daimler-Benz Aktiengesellschaft, Germany

[21] Appl. No.: 677,863

[22] Filed: Apr. 16, 1976

[30] Foreign Application Priority Data

Apr. 22, 1975 Germany ..... 2517682

[51] Int. Cl.[2] ..... F02M 47/00; B05B 5/00

[52] U.S. Cl. ..... 123/119 E; 239/15; 239/453; 239/533.12

[58] Field of Search ..... 239/15, 453, 456, 459, 239/533.1, 533.2, 533.12; 123/119 E, 32 SJ, 151

[56] References Cited

U.S. PATENT DOCUMENTS

| | | | |
|---|---|---|---|
| 3,269,446 | 8/1966 | Luther | 239/15 X |
| 3,347,470 | 10/1967 | Svoboda | 239/453 |
| 3,510,112 | 5/1970 | Winquist et al. | 239/453 X |
| 3,727,636 | 4/1973 | Simmons | 239/453 X |
| 3,749,545 | 7/1973 | Velkoff | 123/119 E X |

*Primary Examiner*—Robert W. Saifer

*Assistant Examiner*—Andres Kashnikow

*Attorney, Agent, or Firm*—Craig & Antonelli

[57] ABSTRACT

An injection valve for internal combustion engines with a valve member forced against its valve seat opposite the injection direction by a spring force and adapted to be lifted off from the valve seat in the injection direction by the hydraulic pressure in the fuel liquid to be injected, and in which the fuel liquid is adapted to be sprayed off in the form of a spray cone; the valve seat is thereby arranged at the end of an electrically conductive tubular spacer member electrically conductively connected with the valve housing and projecting from the valve housing; the outer diameter of the tubular spacer member is thereby considerably smaller than a characteristic valve housing dimension within the area of the connecting place of the spacer member with the valve housing while an annular electrode is arranged at a spacing about the discharge place of the valve which is electrically insulated with respect to the valve housing and the spacer member; the front end edge of the annular electrode, as viewed in the injection direction, has a larger spacing from the valve housing than from the spacer member while its rear end edge lies outside of the spray cone; an electrical potential is applied to the annular electrode with respect to the valve housing.

29 Claims, 2 Drawing Figures

INJECTION VALVE FOR INTERNAL COMBUSTION ENGINES

Figure 1:
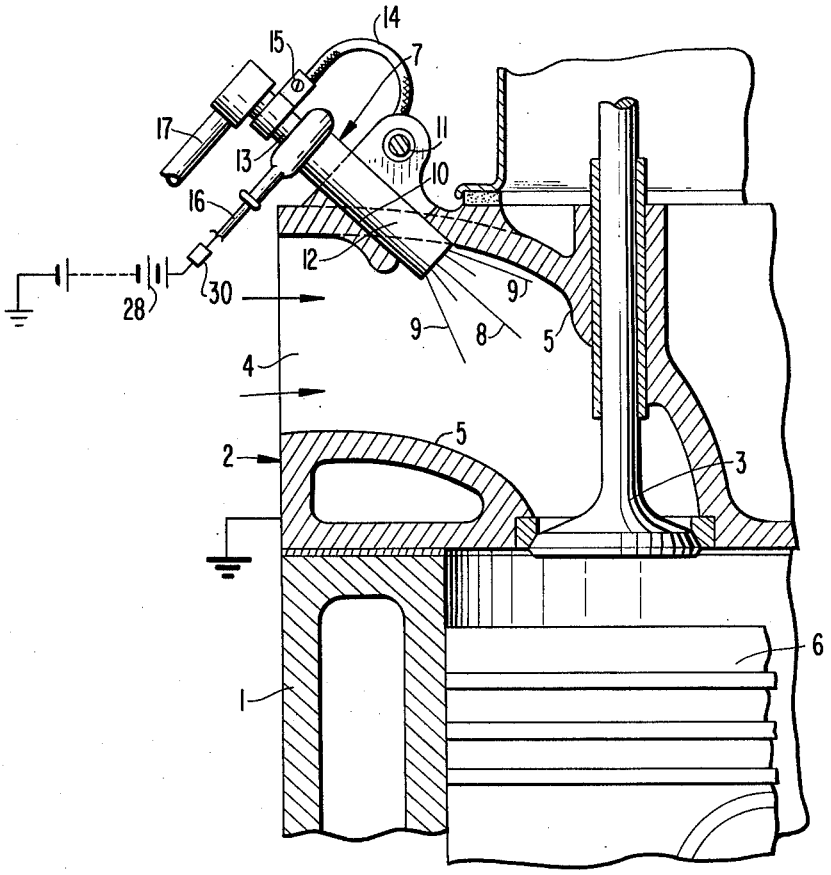

The present invention relates to an injection valve for internal combustion engines, especially to a low-pressure injection valve for mixture-intaking internal combustion engines, with a conically shaped valve member prestressed against the valve seat by a spring force in a direction opposite to the injection direction and retained by a valve stem, which valve member is adapted to be lifted off from the valve seat in the injection direction by the hydraulic pressure in the liquid to be injected, whereby the fuel liquid is adapted to be sprayed off or discharged from the valve opening in the form of a spray cone by reason of a valve closure gap in the form of a truncated cone.

This type of valve on the basis of its principle is designated for the most part as unidirectional valve or also as disk or plate valve because the lift-off direction of the valve member is unidirectional with i.e., is directed in the same direction as the through-flow direction and because the valve seat is sealed off by means of a valve disk retained from the inlet side. The aforementioned injection valves are arranged for the most part in the suction pipe of the internal combustion engine, i.e., outside of the combustion space so that the injection counterpressure is relatively low. By reason of the spraying or atomizing of the fuel in a spray or atomizing cone, the fuel leaving at the valve is distributed at higher rates of fuel flow over a large space and is thereby distributed also into relatively small droplets. At higher rates of fuel flow, a utilizable air/fuel mixture is therefore achieved with the injection valves which are arranged, for example, in the suction pipe and inject for the most part continuously. With small rates of flow as occur in the partial load range or in the idling of the internal combustion engine, the attainable mixture quality, however, leaves a great deal to be desired because the fuel liquid in that case is not injected in a closed spray jet rapidly breaking-up into a large number of individual droplets but rather in individual jets which result by reason of machining- or other roughnesses of the valve closure surfaces, whereby the individual jets extend along the imaginary outer surface of the spray cone or at least in proximity thereof. In contradistinction to a liquid-film expanding conically shaped which for continuity reasons must become ever thinner and accordingly must decompose or split-up into individual droplets, an individual jet can maintain itself stable for a considerably longer period of time before it decomposes or splits up into droplets. The consequence thereof is that with small rates of liquid flow through the aforementioned injection valves, the proportion of the wall wetting and the proportion of the large drops is much greater than with high rates of flow. In order to therefore achieve a quite steady operation of the internal combustion engine which is operationally reliable, the mixture has to be over-enriched during the idling and at low partial loads in order to assure that during each working cycle the minimum quantity in ignitable air/fuel mixture required for this operating condition is available in each working cylinder. The fuel particles which adhere at the wall and are torn along into the combustion space pass over non-combusted or incompletely combusted through the exhaust into the atmosphere and represent an environmental nuisance.

It is the aim of the present invention to improve the aforementioned injection valve with a view toward a better spray or atomizing behavior at small rates of flow. This is achieved according to the present invention in that the valve seat is arranged at the end of an electrically conductive tubular member (spacer pipe) projecting from the valve housing and conductively connected with the also electrically conductive valve housing which is as thin-walled as possible and surrounds the valve stem with an intermediate space, whereby the spacer tubular member which is considerably smaller in outer diameter than a characteristic valve housing dimension within the area of the connecting place of the spacer tubular member with the valve housing, and in that an areal (large-surface) annular electrode electrically insulated with respect to the valve housing and with respect to the spacer tubular member which has an electrically conductive connection is arranged about the discharge place of the valve, whose most forwardly located end face—as viewed in the direction of the spray cone axis and in the injection direction—has a greater distance from the valve housing than from the tubular spacer member and whose rearmost end face is located outside the spray cone and in that the annular electrode is placed at an electrical potential with respect to the valve housing.

As a result of these measures, the spray-off place of the valve is arranged both mechanically as also electrically at an exposed place inside of an electric field whereby the tubular spacer member itself serves as one electrode for the electric field. By reason of this exposed location of the discharge place, an increase in field line density will occur thereat and a local field magnification or increase will take place thereat. In addition to the application of a spray system, known in principle, of fuel liquid with the aid of electrostatic forces, this field increase is the aim of the measures according to the present invention. In order to achieve a noticeable electrostatic spray effect, a very high field strength gradient must be present in the immediate area of the discharge place of the liquid. However, the voltage which can be applied between the electrode and the discharge place cannot be selected suitably high by reason of the danger of voltage arc-overs but instead must remain below the arcing-over limit. In addition to the selected electrode distance, above all the electrical conductivity and the dielectric strength of the respective fuel liquid as well as the pressure in the atomizing space are determinative therefor. Owing to the exposed arrangement in accordance with the present invention of the discharge place of the injection valve in the electric field, the field strength gradient may be drastically increased within the area of the discharge place notwithstanding a voltage difference between the electrode and the discharge place which remains below the arc-over limit. Consequently, the discharge place is to be located at a place which is as small as possible and which is as strongly exposed in the field as possible. In contrast thereto, the counter-electrode is to be constructed as large-surfaced as possible, i.e., is to be so constructed and arranged that it appears under as large as possible a solid angle—as viewed from the discharge place. The discharge place is to attract as large as possible a number of the field lines starting from the counter-electrode. It is also to be avoided that the counterelectrode will be moved too close to the valve housing and that arcing-overs might occur, for example, between the counter-electrode and the valve housing.

The formed particles become charge carriers as a result of the electrostatic spraying of the fuel liquid and more particularly of that polarity which the discharge place has with respect to the counter-electrode. Consequently, an attraction force is exerted on the droplets by the counter or ring electrode. In order to avoid a wall impact at the electrode and therewith a forcible coagulation of the droplets, the electrode is displaced out of the spray cone. The distance of electrode from the spray cone must not be too small. The mass forces of the liquid particles initially sprayed off purely hydraulically with a predetermined starting velocity—the jet velocity—which are then decomposed into droplets by electrostatic forces, these mass forces of the droplets flying with a predetermined velocity and in a predetermined direction must therefore predominate compared to the attraction forces of the electrode so that the droplets can be somewhat deflected at best but do not impinge on the electrode.

In order that local field increases are approximately equally large over the entire circumference of the discharge opening and the entire circumference of the spray cone is being seized uniformly by the electrostatic forces, it is appropriate if the annular electrode is arranged coaxially to the spray cone axis. The same goal is thereby also served by arranging the end faces of the annular electrode perpendicular to the electrode axis and therewith also perpendicular to the spray cone axis.

It was already indicated hereinabove that the annular electrode should be of large surface; by this is meant only that the electrode is to be areal (large-surfaced) with a view toward its formation of larger coherent potential surfaces, i.e., is to be electrostatically large-surfaced, so to speak of. It would be possible to utilize as electrode, for example, a cylindrical wire mesh or a helically wound wire. However, it is still more simple mechanically if the annular electrode is constructed as solid electrode, for example, as small pipe section of a brass pipe. The insulated mounting of the electrode is then much more simple by reason of its inherent rigidity.

It is of advantage for a still stronger concentration of the field lines on the immediate edge of the discharge opening if the tubular spacer member is scarfed or chamfered on the outside of the valve seat end in the shape of a truncated cone. The measure to construct the edge of the valve member sharp-edge in cross section aims in the same direction. Furthermore, the side of the valve member opposite the valve seat may be hollowed out. The surface of the free side of the valve disk which can be viewed from the annular electrode is reduced by the hollowing out. Stray or leakage field lines from the free valve disk side are thereby also displaced in the direction toward the edge of the valve disk.

Accordingly, it is an object of the present invention to provide an injection valve for internal combustion engines, especially a low-pressure injection valve for mixture-intaking internal combustion engines, which avoids by simple means the aforementioned shortcomings and drawbacks encountered in the prior art.

Another object of the present invention resides in an injection valve for internal combustion engines in which a good mixture quality is maintained during idling and in the partial load range of the engine without the need for over-enrichment.

A further object of the present invention resides in an injection valve for internal combustion engines in which proper operation of the engine is assured over the entire load range without accompanying emission of uncombusted or incompletely combusted fuel particles in the exhaust system of the engine.

Still another object of the present invention resides in an injection valve for internal combustion engines which assures a better spray and atomizing behavior at small rates of fuel flow.

Still a further object of the present invention resides in an injection valve for internal combustion engines utilizing an electrostatic assist for the injection process in which a local increase in the field density is made possible without danger of arcing-over.

A further object of the present invention resides in an injection valve for internal combustion engines with electrostatic means in which the field gradient within the area of the discharge place can be drastically increased to improve the injection process without danger of arcing-over between the electrode and the discharge place.

A still further object of the present invention resides in an injection valve for internal combustion engines which decomposes the fuel droplets by electrostatic forces, yet avoids a coagulation of the droplets at the walls of the electrode due to impingement thereof.

Figure 2:
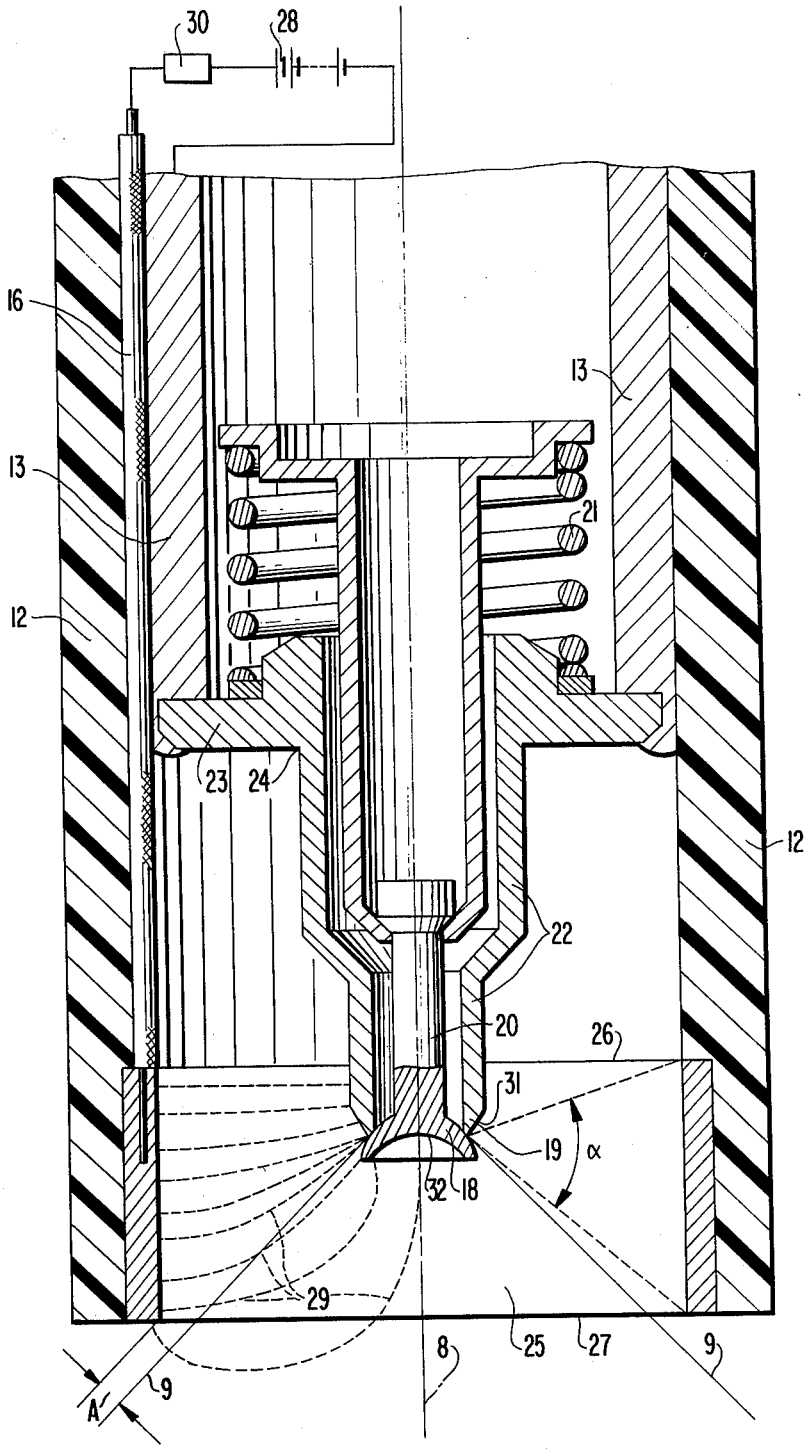

These and other objects, features and advantages of the present invention will become more apparent from the following description when taken in connection with the accompanying drawing which shows, for purposes of illustration only, one embodiment in accordance with the present invention, and wherein:

FIG. 1 is a partial cross-sectional view of an internal combustion engine illustrating the arrangement of an injection valve in accordance with the present invention at the cylinder head of the internal combustion engine; and FIG. 2 is an enlarged longitudinal cross-sectional view through the forward end of the injection valve according to the present invention.

Referring now to the drawing wherein like reference numerals are used throughout the two views to designate like parts, FIG. 1 illustrates in the partial cross-sectional view of an internal combustion engine, a cylinder head 2 mounted on an engine block 1; the cylinder head 2 includes a suction channel 4 delimited by walls 5 and adapted to be closed by an inlet valve 3. A pulsating flow exists in the suction channel 4 in dependence on the reciprocating piston 6 which moves up and down.

An injection valve generally designated by reference numeral 7 is arranged ahead of or upstream of the valve 3—as viewed in the flow direction—which discharges into the suction channel 4. The injection valve 7 is arranged with the axis 8 of the spray cone 9 approximately tangentially to the channel flow and is directed toward the valve disk of the inlet valve 3. The injection valve 7 is constructed externally cylindrically and is clamped fast in a longitudinally slotted clamping bore 10 provided in the suction pipe wall 5 by means of the clamping bolt 11. The outer portion 12 of the valve 7 which is directly clamped fast in the clamping bore 10 is made of electrically insulating material, i.e., forms a pipe or tubular insulator 12. The electrically conductive housing portion 13 of the valve 7 is electrically conductively connected with the cylinder head 2 by means of the cable 14 and the clamp 15 and is thereby—like the cylinder head 2—electrically connected with "ground" or with zero potential. A voltage supply cable 16 is extended toward the outside at the pipe insulator 12 at the top by way of a rubber cap. The fuel supply line 17 is connected to the valve housing 13, properly speaking, at the upper end. In the illustrated embodiment with an injection valve arranged upstream of the inlet valve 3, the injection line 17 is continuously under pressure and accordingly gasoline is continuously injected into the suction channel 4 which is under slight pressure.

The enlarged illustration of FIG. 2 shows the tip of the injection valve in longitudinal cross section. The pipe-shaped or tubularly shaped valve housing 13 of electrically conductive material, for example, of steel is inserted concentrically into the also tubularly shaped insulator 12, the pipe insulator 12, and is held fast therein in a predetermined axial position. The valve includes an opening having an opening edge 19, which is adapted to be closed by a plate or disk valve member 18. The valve disk 18 is held by a valve stem 20 and is forced in the closing direction by the force of the spring 21. The valve disk 18 and the opening edge 19 form a conically shaped valve seat 18/19 whose axis extends coaxially to the axis of the valve housing 13. By reason of this construction, a cone-shaped spray jet—a spray cone 9—with the axis 8 is formed by reason of this configuration.

The outlet or discharge opening of the valve 7 is arranged according to the present invention at the end of a thin-walled tubular spacer member 22 projecting from the valve housing 13 or from the flanged-in plate 23 which is to be still considered as part of the valve housing; the tubular spacer member 22 is considerably smaller in diameter than a characteristic housing dimension at the connecting place 24, for example, the housing-pipe diameter. The tubular spacer member 22 is also made of electrically conductive material and is conductively connected with the housing 13. A position of the discharge opening of the injection valve results therefrom which is exposed both electrically as also mechanically.

An annular electrode 25 is mounted on the inner side of the tubular insulator 12 at the free end thereof, surrounding the discharge opening of the valve, which is connected with the cable 16. For achieving an axially symmetrical field, the electrode 25 is arranged coaxially to the tubular spacing member 22 and to the discharge opening while the end faces 26 and 27 of the electrode 25 are arranged perpendicular to the axis. The annular electrode 25 is constructed large-surfaced and is so mounted and constructed that—as viewed from the opening edge 19—it appears under a solid angle (angle $\alpha$) which is as large as possible. Conversely, measures are taken in order that the discharge opening or the immediate edges thereof appear under a solid angle which is as small as possible—as viewed from any point of the electrode 25. The annular electrode 25, however, cannot be constructed as large as one desires; its axial extent is limited. Thus, for example, the rear end edge 26 of the annular electrode 25 is displaced forwardly in the injection direction so far that it has a larger distance from the valve housing 13 or the plate 23 than the tubular spacer member 22 while the front end edge 27 is displaced so far rearwardly in the injection direction that it is located with certainty outside of the spray cone 9—as indicated in FIG. 2 by the distance A. In order to let the opening edges of the discharge opening of the injection valve appear under a solid angle which is as small as possible as viewed from the annular electrode 25, the tubular spacing member 22 is scarfed or chamfered in the shape of a truncated cone toward the opening edge, as indicated by the cone surface 31, and the valve disk is hollowed out concavely on the side opposite the valve seat, as indicated by the hollowed-out portion 32. The annular electrode 25 is constructed as solid electrode which simplifies its fastening at the tubular insulator.

The annular electrode 25 is placed at a potential of about 2.5 to about 5 kV by means of a conventional voltage source 28. As a result thereof, an electric field indicated by the field lines 29 forms between the electrode 25 and the tubular spacer member 22. The potential magnitude is to be so selected that voltage arc-overs are avoided with certainty. The arcing-over limit—apart from the once determined electrode distance —is also dependent from the electrical conductivity and the dielectric strength of the fuel liquid which may be very different from one another depending on the type of fuel and additives. Furthermore, the arcing-over limit depends on the pressure in the atomizing space. Thanks to the described exposed arrangement in accordance with the present invention of the discharge opening in the electric field, a field line concentration will take place in the area of the discharge opening and thus a local field magnification or increase will occur within this area. By reason of this measure, a very high field strength gradient will be achieved within the discharge area so that notwithstanding a sufficient safety spacing of the overall voltage from the arcing-over limit, an electrostatic liquid spraying or atomization can be achieved to a considerably extent. Especially when the rates of flow are small and accordingly, the hydraulic spray forces are slight and are nearly ineffective, a fine spray mist can be achieved with the aid of the valve construction in accordance with the present invention. The mist droplets receive an electric charge which is determined in its sign according to that of the tubular spacer member 22; accordingly, an attraction force is exerted on the droplets by the electrode 25.

It is assured by the distance A of the spray cone 9 from the annular electrode 25 that the liquid initially sprayed off purely hydraulically with a certain jet velocity, which are then decomposed by electrostatic forces into individual droplets, that these flying droplets can therefore not inpinge on the electrode. The mass inertia of the droplets and the inertia behavior in a trajectory are larger by reason of the distance A than the attraction forces of the electrode so that the droplets fly pass the electrode.

By reason of the mechanical and aerodynamic shielding action of the tubular insulator, the discharge place of the injection valve is arranged—as viewed in the fine area—within a so-called dead-water area from a flow point of view so that the spray cone can form at ease unimpaired or unprevented by air currents.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An injection valve for an internal combustion engine, which comprises a valve housing means, an approximately conically shaped valve means prestressed against its valve seat means by a spring force opposite the injection direction, said valve means being operably to be lifted off in the injection direction from its valve seat means by hydraulic pressure in the fuel liquid to be injected, a valve stem for said valve means, and a valve opening means, the fuel liquid being operable to be sprayed off from the valve opening means in the form of a spray cone by reason of a valve closure gap in the shape approximately of a truncated cone, characterized in that the valve seat means is arranged at the end of an electrically conductive tubular member, said tubular member being electrically conductively connected with the valve housing means and being considerably smaller in its outer diameter than a characteristic valve housing dimension within the area of the connecting place of the tubular member with the valve housing means, and in that an annular electrode means electrically insulated with respect to the valve housing means and with respect to the tubular member is arranged at a distance about the discharge place of the valve, said annular electrode means having a first end edge—as viewed in the direction of the spray cone and in the injection direction—which has a larger distance with respect to the valve housing means than with respect to the tubular member and a second end edge which is located outside of the spray cone.

2. An injection valve for internal combustion engines according to claim 1, characterized in that the tubular member projects from the valve housing means, surrounds the valve stem with an intermediate space and forms a tubular spacer member.

3. An injection valve according to claim 2, characterized in that the tubular member is relatively thin-walled.

4. An injection valve according to claim 3, characterized in that the annular electrode means is of large area construction and has an electrically conductive connection.

5. An injection valve according to claim 1, characterized in that the injection valve is a low pressure injection valve for mixture-intaking internal combustion engines.

6. An injection valve according to claim 4, characterized in that the annular electrode means is operable to be placed at an electrical potential with respect to the valve housing means.

7. An injection valve according to claim 2, characterized in that the annular electrode means is arranged substantially coaxially to a longitudinal axis at the spray cone.

8. An injection valve according to claim 7, characterized in that the first and second end edges of the annular electrode means are arranged perpendicularly to the longitudinal axis of the spray cone.

9. An injection valve according to claim 8, characterized in that the annular electrode means is constructed of solid material.

10. An injection valve according to claim 9, characterized in that the annular electrode means is so constructed that it appears under a relatively large solid angle as viewed from the valve opening means.

11. An injection valve according to claim 10, characterized in that a distance of the annular electrode means from the tubular member is above an arcing-over limit.

12. An injection valve according to claim 11, characterized in that the tubular member is chamfered on the outside at an one end of the valve seat means in the shape of a truncated cone.

13. An injection valve according to claim 12, characterized in that an edge of the valve means is constructed sharp-edged in cross section.

14. An injection valve according to claim 13, characterized in that a side of the valve means opposite the valve seat means is hollowed out.

15. An injection valve according to claim 14, characterized in that the annular electrode means is operable to be placed at an electrical potential with respect to the valve housing means.

16. An injection according to claim 1, characterized in that the first and second end edges of the annular electrode means are arranged perpendicularly to the longitudinal axis of the spray cone.

17. An injection valve according to claim 1, characterized in that the annular electrode means is constructed of solid material.

18. An injection valve according to claim 1, characterized in that the annular electrode means is so constructed that it appears under a relatively large solid angle, as viewed from the valve opening means.

19. An injection valve according to claim 1, characterized in that the distance of the annular electrode means from the tubular member is above a arcing-over limit.

20. An injection valve according to claim 1, characterized in that the tubular member is chamfered on the outside an end of the valve seat means in the shape of a truncated cone.

21. An injection valve according to claim 1, characterized in that an edge of the valve means is constructed sharp-edged in cross section.

22. An injection valve according to claim 21, characterized in that a side of the valve means opposite the valve seat means is hollowed out.

23. An injection valve for an internal combustion engine, the injection valve comprising: a valve housing means, an electrically conductive tubular member arranged at an end of said valve housing means and electrically conductively connected thereto, a valve seat means arranged at an end of said tubular member, a valve means displaceably mounted in said valve housing means and cooperating with said valve seat means so as to selectively define a valve opening means for injecting a supply of fuel in the form of a spray cone, an annular electrode means arranged at the injection valve so as to be coaxial with said tubular member and surround the valve opening means, said annular electrode means being electrically insulated from said tubular member, said annular electrode means including first and second axially spaced end edges, each extending perpendicular to a longitudinal axis of the spray cone, said annular electrode means having an axial dimension such that said first end is disposed upstream of said valve opening means, as viewed in a fuel injection direction, with said second edge being disposed outside of the spray cone, and having a radial dimension which is larger than a radial dimension of said tubular member such that a space is defined between an inner surface of said annular electrode means and an outer surface of said tubular member with said valve opening means discharging into said space, and wherein, upon a placing of a potential at the annular electrode means from a voltage source, an electric field forms between said annular electrode means and said tubular member for decomposing liquid particles of the spray cone by electrostatic forces into individual droplets.

24. An injection valve according to claim 23, in a suction channel of an internal combustion engine, wherein the longitudinal axis of the spray cone extends approximately tangentially to a channel flow and is directed toward a valve disc of an inlet valve means of the internal combustion engine.

25. An injection valve according to claim 23, wherein the valve housing means includes a tubularly-shaped housing, and wherein a tubularly-shaped insulator means is arranged about said tubularly-shaped housing and secured thereto in a predetermined axial position, said annular electrode means being mounted on an inner side of a free end of said insulating tube means.

26. An injection valve according to claim 25, wherein said annular electrode means is constructed of a solid material.

27. An injection valve according to claim 26, wherein said tubular member is relatively thin-walled.

28. An injection valve according to claim 27, wherein the tubular member is chamfered on the outside at an end of the valve seat means in the shape of a truncated cone.

29. An injection valve according to claim 28, wherein a side of the valve means disposed opposite the valve seat means is provided with a hollowed-out portion.

* * * * *